US007066844B1

(12) United States Patent
Noggle

(10) Patent No.: US 7,066,844 B1
(45) Date of Patent: Jun. 27, 2006

(54) GOLF TEE

(76) Inventor: Michael K. Noggle, 17 Redbird, Irvine, CA (US) 92603

( * ) Notice: Subject to any disclaimer, the term of this patent is extended or adjusted under 35 U.S.C. 154(b) by 0 days.

(21) Appl. No.: 10/771,703

(22) Filed: Feb. 4, 2004

Related U.S. Application Data

(60) Provisional application No. 60/445,418, filed on Feb. 5, 2003.

(51) Int. Cl.
*A63B 57/00* (2006.01)

(52) U.S. Cl. ..... 473/387; 473/400

(58) Field of Classification Search ..... 473/387–403; D21/717, 718
See application file for complete search history.

(56) References Cited

U.S. PATENT DOCUMENTS

| | | | | | |
|---|---|---|---|---|---|
| 1,584,832 | A | * | 5/1926 | Benneke | 473/388 |
| 1,597,740 | A | * | 8/1926 | Thompson | 473/394 |
| 1,645,001 | A | * | 10/1927 | Hodges | 473/399 |
| 1,936,625 | A | * | 11/1933 | Goldman | 473/398 |
| D99,117 | S | * | 3/1936 | Drinkert | D21/718 |
| 2,153,260 | A | * | 4/1939 | Mayl | 473/389 |
| 3,079,158 | A | * | 2/1963 | Finn et al. | 473/396 |
| 4,783,077 | A | * | 11/1988 | Lemon | 473/402 |
| 5,052,689 | A | | 10/1991 | Lettrich | |
| 5,242,161 | A | | 9/1993 | Wilkirson | |
| 5,356,146 | A | * | 10/1994 | Blosser | 473/400 |
| 5,890,976 | A | * | 4/1999 | Anderson | 473/398 |
| 6,139,449 | A | * | 10/2000 | Cardarelli | 473/387 |
| D453,810 | S | * | 2/2002 | Lee | D21/717 |
| 6,454,669 | B1 | | 9/2002 | James | |
| D485,317 | S | * | 1/2004 | Cardarelli | D21/718 |
| 2005/0064959 | A1 | * | 3/2005 | Ortiz | 473/387 |

* cited by examiner

*Primary Examiner*—Steven Wong
(74) *Attorney, Agent, or Firm*—Knobbe, Martens, Olson & Bear, LLP

(57) ABSTRACT

Disclosed is a golf tee having a plurality of stops formed thereon to indicate the depth of penetration of the tee into the ground, the stops being constructed such that the user can sense or feel the first stop that indicates to the user that the tee has been inserted to a desired depth for use with a large club head. The tee, however, can be easily inserted further to a depth marked by a second stop, which positions the tee head at a desired location for a smaller club head.

9 Claims, 1 Drawing Sheet

GOLF TEE

This application claims the benefit of U.S. Provisional Application No. 60/445,418, filed Feb. 5, 2003, the entirety of which is hereby incorporated by reference therein.

BACKGROUND OF THE INVENTION

1. Field of the Invention

This invention relates to golf tees.

2. Description of the Related Art

In the sport of golf the first shot on each hole is usually made by striking a ball resting on a tee. Golf tees are generally about 2" in length and made of wood though some are made from polymers. A golf tee has a ball-holding end and a pointed end for inserting into the ground. Both ends are subject to improvements. In recent years design changes in clubs, and particularly drivers, have resulted in a breed most often referred to as, "large head" clubs.

These "large head" drivers have made longer tees more popular as the center of the driver head has moved further from the ground.

There is a problem with these longer tees as they are often so long that it is difficult to adjust them to the ideal height on a consistent basis. Equally difficult is the balancing of a ball on a standard length tee when using a "large head driver. Standard tees are simply too short to position the ball in the "sweet spot" of the clubface. Golfers spend a great deal of time literally trying to balance the ball on the tee that has been minimally inserted into the teeing ground. It is not unusual to see the tee fall over with the ball. A great deal of time is spent re-teeing to get it right.

A golf instructor's first order of business is generally to preach the virtues of repeatability of the entire process of swinging at a golf ball. A tee that can be easily inserted to a repeatable height would be a major improvement in that process. Further, the tee must be capable of providing a stable platform for the ball in a wide variety of terrain.

There have been a large number of attempts to control the height of the golf tee extending above the ground. In one example currently being marketed, a regular tee is provided with a large diameter cylindrical portion directly beneath the top of the tee that creates a stop, limiting the depth of insertion of the tee. While that approach is useful, it provides no variation or adjustability which is needed because of the variety in the size of golf club heads and personal preference for a specific height.

The prior art also includes various arrangements in which one or more elements in addition to the golf tee are employed to adjust the vertical position of a golf tee to fit a golfer's needs.

In spite of these various developments, a need still exists for an improved tee that provides the necessary adjustability of a golf tee, but is nevertheless simple and sufficiently inexpensive to be practical.

SUMMARY OF THE INVENTION

A golf tee is provided that has a small diameter lower end terminating in a sharp tip. At a predetermined distance above the tip, the cross section of the tee is increased an amount sufficient to enable a golfer to feel the increased resistance to penetration at the point of increased cross section. That depth of penetration indicates the approximate length of tee above that point, which would be a desirable location for positioning the golf ball to be hit by a "large head" golf club. Although the increase in cross section can be felt by the golfer, the tee can normally be inserted further without difficulty. In other words, the area of increased cross section would provide a rather "soft stop." At a predetermined distance above the soft stop, the cross section of the tee would be once more be increased to provide a second stop, which might, for example, indicate the desired height of the tee above the ground for a golf club having a smaller head.

In addition to the increase in cross section at the stops on the tee, a visual band or marker can be placed on the tee at those stops or at a maximum insertion location to provide visual indication for the golfer.

In a preferred form of the invention, the soft stop is provided by a plurality of vertically extending ribs circumferentially spaced around the periphery of the golf tee. The lower ends of those ribs provide the soft stop, while the ribs permit further insertion of the tee if that is desired. Further, a second or third stop could also be formed by increasing the radial length of such ribs.

In an alternative arrangement, the entire circumference of the tee at the location of the first soft stop is increased to provide the stop. The diameter of the tee at that soft stop can be slightly smaller than that with the rib version in that the annular ledge still provides enough material for the soft stop equal to that of the spaced ribs. Similarly, a second or third stop on the tee can simply have an increased diameter. However, it should be noted that if more than two stops are desired, the second stop should not be so large as to prevent insertion of the tee to a greater depth without undue difficulty.

DETAILED DESCRIPTION OF THE PREFERRED EMBODIMENT

Figure 1:
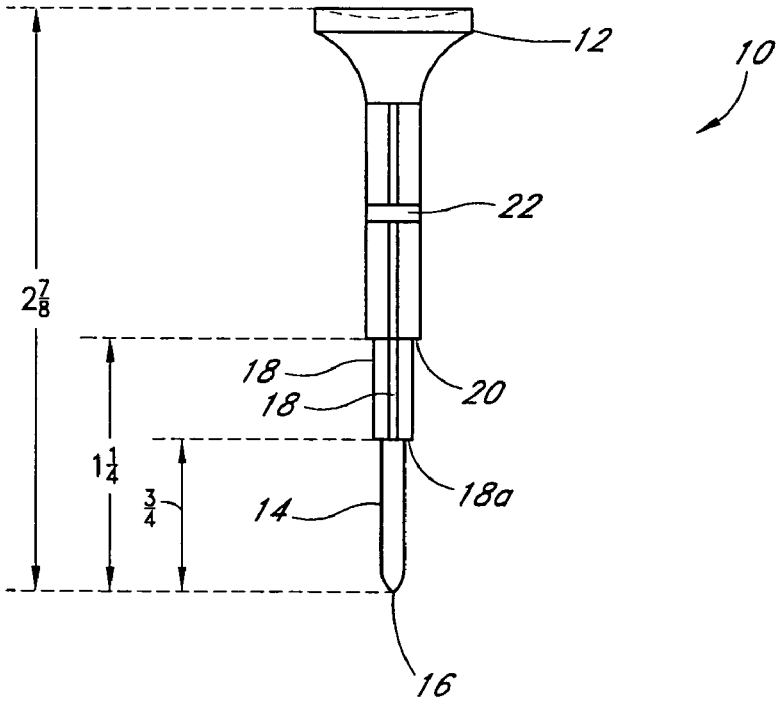
FIG. 1 illustrates a preferred form of the golf tee of the invention.

Referring to FIG. 1, there is illustrated a golf tee 10 approximately 2 and ⅞" in length with an annular top 12 approximately ½" in diameter with a concave upper surface for receiving a golf ball. An end portion or lower section 14 is smaller in diameter than a standard golf tee. Except for the pointed tip 16, the section 14 is preferably cylindrical and has a diameter of only about ⅛". It is, therefore, easy to insert into the soil. Preferably, that lower section 14 is about ¾" in length and, hence, there is sufficient length to provide a stable platform in almost any soil.

A first portion of the body of the tee at the upper edge of the lower section 14 is provided with a plurality of circumferentially spaced, vertically extending ribs 18. The ribs extend radially outwardly about 1/16", and thus the diameter of the cylinder circumscribing the ribs is about ¼." This is twice that of the lower section. The increased tee cross-section by the lower ends 18*a* of these ribs can be felt and this provides a "soft stop," that makes it easy to set the tee at the same height quickly and easily. This first stop indicates the maximum height for positioning the golf ball above the ground, which is 2 and ⅛" with the given tee length.

Since the cross sectional area produced by the end faces of the ribs is relatively small, the tee is easily further inserted into the soil should the golfer desire the tee upper end to be set at a lower height. In a preferred arrangement, the ribs along a second portion of the body might increase in radial dimension to define a circumscribed cylinder of about 5/16", or ⅜" diameter, to thus provide a second stop 20. The distance between the first and second stops is preferably about ½," thus reducing the tee height above the ground to about 1 and ⅝". If desired, additional stops may be provided. Also, should the soil be exceptionally loose or muddy, the soft stops provide a visual mark to accomplish the same result as a sensory stop. An annular ring 22 might provide a more fixed final stop. Thus, this tee provides several methods, visual and sensory, to quickly position a golf ball at a consistent height.

Figure 2:
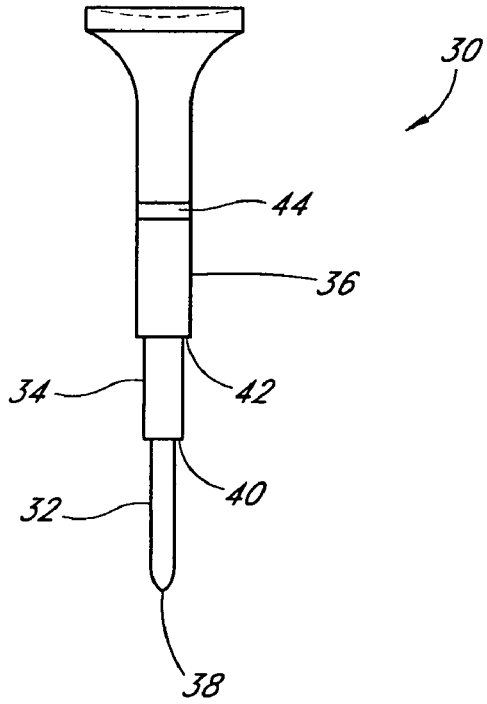
FIG. 2 illustrates a second embodiment of the invention

Referring to FIG. 2, a tee 30 forming another embodiment of the invention simply has a series of cylindrical sections 32, 34 and 36 beginning with a pointed tip that leads to the ⅛" diameter penetration end. Approximately ¾" from the pointed tip 38, the tee diameter increases to approximately 3/32", which provides a soft stop 40. As noted above, the circumference of that annular stop can be slightly less than that provided with the rib approach because of the resistance to penetration provided by the annular ledge marking the soft stop. Several similar increased steps of diameter may be added to allow one or more stops 42 when inserting the golf tee. Again, visual marks such as one or more annular rings 44, may be added to provide visual, as well as sensory assistance, in setting the tee at a consistent height. The mark can be a recess in the tee, paint, or other suitable means.

The tee of FIG. 1 is preferably made by injection molding of a suitable polymer, biodegradable or a longer lasting type. The tee of FIG. 2 can likewise be made of plastic, or it can be machined of wood, as with conventional tees.

In summary, it can be seen that the one piece tee of the invention is designed to increase the proficiency of a golfer by providing a level of consistency to the game. The soft stop sets the ball to the desired same height every time, and is the optimal height for most large head drivers. The second stop with a lower setting for the ball might be desirable for a number three wood. If desired, the rib design allows the stops to be easily overridden by pushing the tee deeper into any position desired. Repeating the setting to adopt for the golfer's swing, is easy with the sensory feedback provided by the stops. The small diameter tip allows the tee to readily penetrate the tee box soil, but the penetration section is long enough to ensure a stable platform for the golf ball. Standard length tees are simply too short, and the extra long tees currently available on the market are difficult to adjust to a consistent height, and they break quite easily.

From the foregoing, it is evident that there are numerous embodiments of the present invention which, while not expressly described above, are clearly within the scope and spirit of the invention. For example, different forms of stops may be provided while employing the concept of a easily recognized soft stop that nevertheless permits further soil penetration to facilitate consistently positioning a golf ball at a desired height.

What is claimed is:

1. A one-piece tee for supporting a golf ball, comprising an elongated body having a head on one end formed to receive and support a golf ball and having an end portion on its other end adapted to penetrate the ground to support the tee head at a desired height, the end portion having a cross-sectional area, a first plurality of ribs of the body extending along at least a first portion of the body adjacent to and spaced upwardly from the end portion, the first portion of the body including the first plurality of ribs having a first constant cross-sectional area larger than the cross-sectional area of the end portion, a first stop formed by the first plurality of ribs where the first portion of the body is adjacent to the end portion, the first stop being constructed to enable a person to sense the increased penetration resistance encountered when the first stop engages the ground so that a first depth of penetration will indicate the approximate amount of the tee extending above the first stop, which would be a desirable location for positioning the golf ball to be hit by a large head golf club, the first stop being further constructed such that the tee can be normally inserted further without difficulty to a second depth desirable for use with a golf club having a smaller head, wherein the tee includes a second plurality of ribs of the body extending along at least a second portion of the body spaced upwardly from the first portion of the body, the second portion of the body including the second plurality of ribs having a second constant cross-sectional area larger than the first constant cross-sectional area, a second stop formed by the second plurality of ribs, the second stop being constructed to provide increased resistance to insertion of the tee into the ground so as to enable the person to sense that the second depth has been reached.

2. The tee of claim 1, wherein the first plurality of ribs extends between the first stop and the second stop.

3. The tee of claim 1, wherein the tee is about three inches in length, the end portion is about three-quarters of an inch in length, and the first portion of the body is about one-half of an inch in length.

4. The tee of claim 1, wherein said body includes visual marking that will indicate to a person the depth at which the tee has been inserted into the ground.

5. A method of positioning the head of a golf tee at a desired distance above the ground, comprising inserting an end portion of the golf tee into the ground until a depth of penetration is reached, the end portion having a cross-sectional area, the depth of penetration indicated by a first stop on the tee at which a person can feel a marked increase in the resistance to insertion, but yet can be readily inserted further, the first stop formed by a first plurality of ribs extending along at least a first portion of the tee adjacent to and spaced upwardly from the end portion, the first portion of the tee including the first plurality of ribs having a first constant cross-sectional area larger than the cross-sectional area of the end portion, the first stop providing an indication of the amount of tee extending above the first stop suitable for use in connection with a large golf club head, wherein the method further comprises inserting the tee further into the ground until a second stop on the tee encounters the ground, the second stop formed by a second plurality of ribs extending along at least a second portion of the tee spaced upwardly from the first portion of the tee, the second portion of the tee including the second plurality of ribs having a second constant cross-sectional area larger than the first constant cross-sectional area, the second stop providing a second increase in resistance to penetration that indicates a second amount of tee extending above the second stop suitable for use in connection with a smaller golf club head.

6. A one-piece tee for supporting a golf ball, comprising an elongated body having a head on one end formed to receive and support a golf ball and having an end portion on its other end adapted to penetrate the ground to support the tee head at a desired height, the end portion having a cross-sectional area, a first plurality of ribs of the body extending along at least a first portion of the body adjacent to and spaced upwardly from the end portion, the first portion of the body including the first plurality of ribs having a first constant cross-sectional area larger than the cross-sectional area of the end portion, a first stop formed by the first plurality of ribs where the first portion of the body is adjacent to the end portion, the first stop being constructed to enable a person to sense the increased penetration resistance encountered when the first stop engages the ground so that a first depth of penetration will indicate the approximate amount of the tee extending above the first stop, which would be a desirable location for positioning the golf ball to be hit by a large head golf club, the first stop being further constructed such that the tee can be normally inserted further without difficulty to a second depth desirable for use with a golf club having a smaller head, wherein the tee further comprises an annular ring spaced upwardly from the first, stop, the annular ring providing a second stop.

7. A one-piece tee for supporting a golf ball, the tee comprising:

a head formed to receive and support a golf ball;

an end portion formed to penetrate the ground so as to support the head at a desired height above the ground, the end portion having a cross-sectional area; and a first portion adjacent to and spaced upwardly from the end portion, the first portion including a plurality of ribs extending at least along the first portion, the first portion including the plurality of ribs having a first constant cross-sectional area larger than the cross-sectional area of the end portion, wherein the plurality of ribs form a first stop where the first portion is adjacent to the end portion, the first stop adapted to engage the ground and to provide increased penetration resistance indicative of a first depth of penetration, wherein the tee further comprises a second portion spaced upwardly from the first portion, the second portion including a second plurality of ribs extending at least along the second portion, the second portion including the second plurality of ribs having a second constant cross-sectional area larger than the first constant cross-sectional area, wherein the second plurality of ribs form a second stop adapted to engage the ground and to provide increased penetration resistance indicative of a second depth of penetration.

8. A one-piece tee for supporting a golf ball, the tee comprising:

a head formed to receive and support a golf ball;

an end portion formed to penetrate the ground so as to support the head at a desired height above the ground, the end portion having a cross-sectional area; and a first portion adjacent to and spaced upwardly from the end portion, the first portion including a plurality of ribs extending at least along the first portion, the first portion including the plurality of ribs having a first constant cross-sectional area larger than the cross-sectional area of the end portion, wherein the plurality of ribs form a first stop where the first portion is adjacent to the end portion, the first stop adapted to engage the ground and to provide increased penetration resistance indicative of a first depth of penetration, wherein the tee further comprises a second portion adjacent to and spaced upwardly from the first portion, wherein the plurality of ribs further extend along the second portion, the second portion including the plurality of ribs having a second constant cross-sectional area larger than the first constant cross-sectional area, wherein the plurality of ribs form a second stop where the second portion is adjacent to the first portion, the second stop adapted to engage the ground and to provide increased penetration resistance indicative of a second depth of penetration.

9. A one-piece tee for supporting a golf ball, the tee comprising:

a head formed to receive and support a golf ball;

an end portion formed to penetrate the ground so as to support the head at a desired height above the ground, the end portion having a cross-sectional area; and a first portion adjacent to and spaced upwardly from the end portion, the first portion including a plurality of ribs extending at least along the first portion, the first portion including the plurality of ribs having a first constant cross-sectional area larger than the cross-sectional area of the end portion, wherein the plurality of ribs form a first stop where the first portion is adjacent to the end portion, the first stop adapted to engage the ground and to provide increased penetration resistance indicative of a first depth of penetration, wherein the tee further comprises an annular ring spaced upwardly from the first stop, the annular ring providing a second stop.

* * * * *